US011931859B2

(12) United States Patent
Ishikawa

(10) Patent No.: US 11,931,859 B2
(45) Date of Patent: Mar. 19, 2024

(54) GRINDER

(71) Applicant: MAKITA CORPORATION, Anjo (JP)

(72) Inventor: Junya Ishikawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 291 days.

(21) Appl. No.: 16/983,588

(22) Filed: Aug. 3, 2020

(65) Prior Publication Data

US 2021/0094147 A1 Apr. 1, 2021

(30) Foreign Application Priority Data

Sep. 26, 2019 (JP) ..... 2019-175940

(51) Int. Cl.

*B24B 47/12* (2006.01)
*B24B 23/00* (2006.01)
*B24B 23/02* (2006.01)

(52) U.S. Cl.

CPC ..... *B24B 47/12* (2013.01); *B24B 23/005* (2013.01); *B24B 23/02* (2013.01)

(58) Field of Classification Search

CPC ..... B24B 47/12; B24B 23/005; B24B 23/02; B24B 47/10; B24B 23/022; B24B 23/028; B24B 23/026; B24B 27/08; B24B 23/03; B24B 55/102; B24B 55/105; B24B 45/00; B24B 45/006

USPC ..... 451/294, 344, 350, 351, 352, 353, 357, 451/358

See application file for complete search history.

(56) References Cited

U.S. PATENT DOCUMENTS

2009/0207035 A1* 8/2009 Watanabe ..... B24B 49/12 340/657
2011/0168422 A1* 7/2011 Fujiwara ..... B24B 23/028 173/217
2013/0112537 A1* 5/2013 Mizutani ..... B25F 5/02 200/337

(Continued)

FOREIGN PATENT DOCUMENTS

JP 2018-111185 A 7/2018

OTHER PUBLICATIONS

Mar. 6, 2023 Office Action issued in Japanese Patent Application No. 2019-175940.

(Continued)

*Primary Examiner* — Brian D Keller
*Assistant Examiner* — Alberto Saenz
(74) *Attorney, Agent, or Firm* — Oliff PLC

(57) ABSTRACT

A grinder includes a motor including an output shaft, a housing accommodating the motor, a switch, a brake member movable back and forth between a rear braking position and a front brake release position, a switch lever movable between an initial position and a depressed position, a sliding member slidable between a first position to move the brake member to the brake release position and a second position to move the brake member to the braking position to turn on the switch at the first position and turn off the switch at the second position, and a link member rotatable between a first rotational position to move the sliding member to the first position and a second rotational position to move the sliding member to the second position.

13 Claims, 8 Drawing Sheets

(56) References Cited

U.S. PATENT DOCUMENTS

| | | | | |
|---|---|---|---|---|
| 2015/0087211 | A1* | 3/2015 | Baykara | B24B 47/26<br>188/74 |
| 2015/0263592 | A1* | 9/2015 | Kawakami | B25F 5/008<br>451/359 |
| 2015/0326098 | A1* | 11/2015 | Hirata | H02K 11/02<br>310/50 |
| 2017/0250038 | A1* | 8/2017 | Esenwein | B25F 5/00 |

OTHER PUBLICATIONS

Apr. 14, 2023 Office Action issued in Chinese Patent Application No. 202010647094.7.
Oct. 28, 2023 Office Action issued in Japanese Patent Application No. 202010647094.7.

* cited by examiner

GRINDER

CROSS-REFERENCE TO RELATED APPLICATIONS

This application claims the benefit of priority to Japanese Patent Application No. 2019-175940, filed on Sep. 26, 2019, the entire contents of which are hereby incorporated by reference.

BACKGROUND

1. Technical Field

The present invention relates to a grinder including a brake assembly that applies a brake to a rotating output shaft of a motor and an interlocking assembly that turns on or off the brake assembly in cooperation with a switch lever.

2. Description of the Background

A known grinder described in, for example, Japanese Unexamined Patent Application Publication No. 2018-111185 includes a brake assembly including a brake plate, a brake member, and a coil spring. The brake plate is fixed to an output shaft of a motor. The brake member faces the brake plate in front and includes a brake shoe. The coil spring presses the brake member toward the brake plate.

The known grinder includes an interlocking assembly including a slide bar. A switch lever turns on or off a switch for driving the motor. When the switch lever is depressed, the slide bar advances toward the brake member to move the brake shoe away from the brake plate. The interlocking assembly is a link member that advances the slide bar when the switch lever is depressed and retracts the slide bar when the switch lever is returned to an initial position. A lever member is located behind the switch lever. The lever member is in contact with a plunger included in the switch and swings vertically in cooperation with the switch lever.

When the switch lever is depressed, the slide bar advances via the link member to cause the brake assembly to release the brake. At the same time, the lever member is depressed and the switch is then turned on to rotate the output shaft. When the switch lever is released from being depressed, the lever member is released from being depressed and the switch is then turned off. At the same time, the slide bar retracts and the brake assembly then operates to apply a brake on the output shaft.

BRIEF SUMMARY

In the known interlocking assembly, the link member releases and operates the brake assembly, and the lever member turns on and off the switch. This structure increases the number of components and can cause a cumulative tolerance lowering the operability or causing the brake assembly and the switch to operate at different times.

One or more aspects of the present invention are directed to a grinder that has a simple structure with fewer components to allow a brake assembly and a switch to operate easily and reliably.

A first aspect of the present invention provides a grinder, including:

- a motor including an output shaft;
- a housing accommodating the motor and extending in a front-rear direction;

- a switch located in the housing and configured to drive the motor;
- a brake member located in the housing and movable back and forth between a rear braking position to apply a brake on the output shaft and a front brake release position to release the brake on the output shaft;
- a switch lever movable between an initial position to protrude from the housing and a depressed position to be depressed into the housing;
- a sliding member located in the housing and slidable between a first position to move the brake member to the brake release position and a second position to move the brake member to the braking position, the sliding member being configured to turn on the switch at the first position and turn off the switch at the second position; and
- a link member located in the housing and rotatable between a first rotational position to move the sliding member to the first position at the depressed position of the switch lever and a second rotational position to move the sliding member to the second position at the initial position of the switch lever.

A second aspect of the present invention provides a grinder, including:

- a motor including an output shaft;
- a housing accommodating the motor and extending in a front-rear direction;
- a switch located in the housing and configured to drive the motor;
- a brake member located in the housing and movable back and forth between a rear braking position to apply a brake on the output shaft and a front brake release position to release the brake on the output shaft;
- a switch lever movable between an initial position to protrude from the housing and a depressed position to be depressed into the housing;
- a sliding member located in the housing and slidable between a first position to move the brake member to the brake release position and a second position to move the brake member to the braking position; and
- a link member located in the housing and rotatable between a first rotational position to move the sliding member to the first position at the depressed position of the switch lever and a second rotational position to move the sliding member to the second position at the initial position of the switch lever, the link member being configured to turn on the switch at the first rotational position and turn off the switch at the second rotational position.

The structure according to the above aspects of the present invention causes the slide bar for turning on and off the brake assembly to turn on and off the switch directly or indirectly via the link member. This structure reduces the number of components and eliminates the likelihood of a cumulative tolerance lowering the operability or causing the brake assembly and the switch to operate at different times. In other words, both the brake assembly and the switch may be operated easily and reliably with a simple structure including fewer components.

DETAILED DESCRIPTION

Embodiments of the present invention will now be described with reference to the drawings.

First Embodiment

Figure 1:
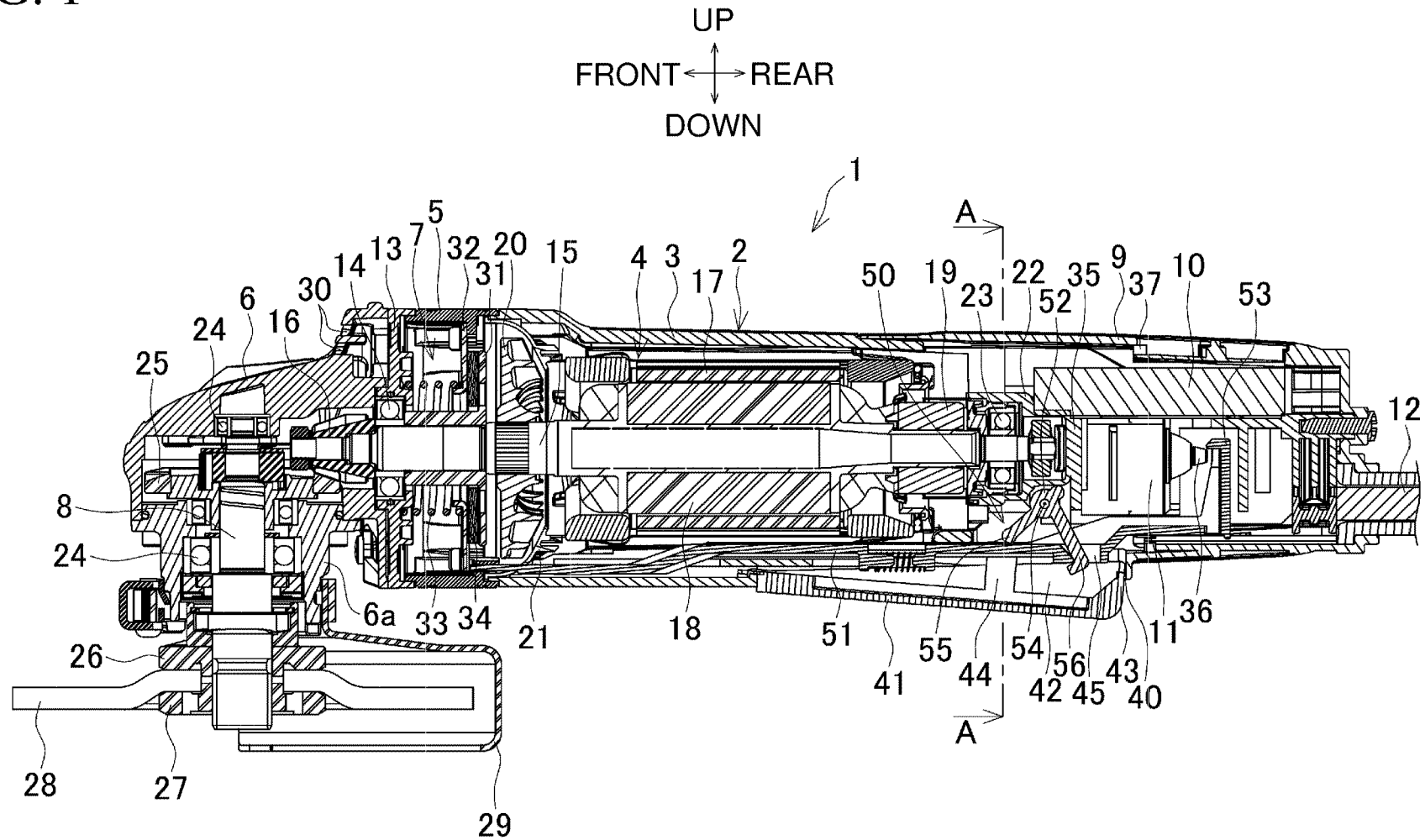
FIG. 1 is a longitudinal central sectional view of a grinder according to a first embodiment in a switch-off state.

FIG. 1 is a longitudinal central sectional view of an example grinder. A grinder 1 includes a housing 2 extending in the front-rear direction. The housing 2 includes a motor housing 3 accommodating a motor 4 in the middle in the front-rear direction. The housing 2 includes a brake holder 5 and a gear housing 6. The brake holder 5 is mounted onto the front of the motor housing 3. The gear housing 6 is mounted onto the front of the brake holder 5. The brake holder 5 accommodates a brake assembly 7. A spindle 8 protrudes downward from the gear housing 6. The housing 2 includes a rear cover 9 mounted onto the rear of the motor housing 3. The rear cover 9 accommodates a controller 10 and a switch 11. The rear cover 9 is connected to a power cord 12 on its rear end.

The motor housing 3 is cylindrical and holds the motor 4 facing frontward. The brake holder 5 is cylindrical. A bearing plate 13 holding a bearing 14 is located between the brake holder 5 and the gear housing 6. The motor 4 includes its output shaft 15 extending through the brake holder 5 and held on the bearing plate 13 via the bearing 14. The output shaft 15 has its distal end protruding into the gear housing 6. The output shaft 15 receives a first bevel gear 16 fastened to the distal end.

The motor 4 is a commutator motor. The motor 4 includes a stator 17 and a rotor 18. The stator 17 is held on the motor housing 3. The rotor 18 extends through the stator 17 and includes the output shaft 15 along its axis. The rotor 18 includes a commutator 19 in its rear portion. The output shaft 15 receives a fan 20 for cooling the motor located in front of the stator 17. The motor housing 3 includes a baffle plate 21 in its front portion. The baffle plate 21 covers the outer periphery of the fan 20 from the rear. The output shaft 15 has its rear end held, via a bearing 23, by a holder 22 in the rear portion of the motor housing 3.

The spindle 8 is held, via upper and lower bearings 24, orthogonal to the output shaft 15 inside the gear housing 6 and a bearing box **6*a*, which is located in the lower portion of the gear housing 6. The spindle 8 receives, on its upper portion, a second bevel gear 25 meshing with the first bevel gear 16. The spindle 8 has its lower end protruding from the bearing box 6*a*. The lower end of the spindle 8 may receive a tip tool 28, such as a grinding disc, in a detachable manner with an inner flange 26 and an outer flange 27. The bearing box 6*a* includes a tool cover 29 on its lower portion. The tool cover 29 covers the rear half of the tip tool 28 from above. The gear housing 6 has multiple outlets 30** in its upper front surface.

The brake assembly 7 includes a brake plate 31, a brake member 32, and a coil spring 33. The brake plate 31 is integrally fixed to the output shaft 15. The brake member 32 receives the output shaft 15 extending through it, and is located in front of the brake plate 31 in a manner movable back and forth. The brake member 32 includes a brake shoe 34 on its rear surface. The coil spring 33 receives the output shaft 15 extending through it, and is located in front of the brake member 32. The coil spring 33 urges the brake member 32 rearward.

In a normal state, the brake member 32 is urged by the coil spring 33 to a braking position (on position), at which the brake shoe 34 is pressed against the brake plate 31. When pressed frontward against the urging force from the coil spring 33, the brake member 32 is at a brake release position (off position), at which the brake shoe 34 is away from the brake plate 31.

The rear cover 9 is shaped in a cup that opens frontward. The rear cover 9 accommodates the holder 22 of the motor housing 3 and a switch receiver 35. The switch receiver 35 is integral with the rear of the holder 22. The switch receiver 35 holds the switch 11 to have a plunger 36 protruding rearward. The switch 11 is a push switch. The switch 11 is turned on when the plunger 36 is depressed. The controller 10 is laterally accommodated to extend in the front-rear direction above the switch 11. The rear cover 9 has multiple inlets 37 (FIG. 7) in its outer circumferential surface.

Figure 2:
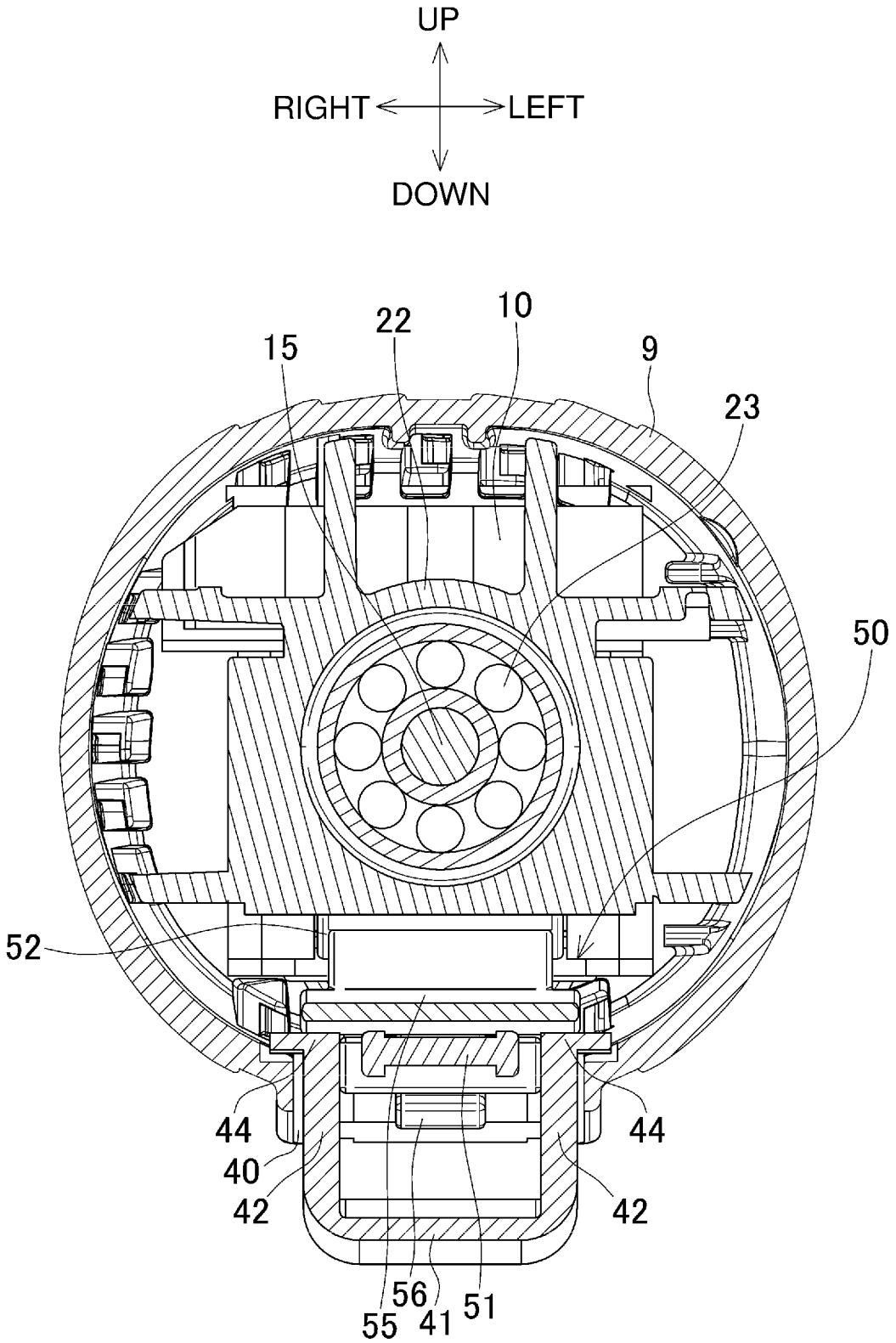
FIG. 2 is an enlarged cross-sectional view taken along line A-A in FIG. 1.

A lever holder 40 is located on the lower surfaces of the motor housing 3 and the rear cover 9. The lever holder 40 has an opening extending in the front-rear direction. The lever holder 40 includes a switch lever 41. The switch lever 41 is used to turn on or off the switch 11. The switch lever 41 is a strip plate in a plan view and extends in the front-rear direction along the opening of the lever holder 40. The switch lever 41 has its front end engaged with the front edge of the lever holder 40 from inside the rear cover 9. The switch lever 41 includes right and left side plates 42 and a rear plate 43 that each stand upward. The right and left side plates 42 have a pair of engagement tabs 44 protruding into the rear cover 9 with the lever holder 40 in between as shown in FIG. 2. Each engagement tab 44 has an upper end bent right or left to be engaged with the inner surface of the rear cover 9.

In other words, the switch lever 41 is held in a manner swingable about its front end in the vertical direction. When swung downward, the switch lever 41 is stopped where the engagement tabs 44 are engaged with the inner surface of the rear cover 9. This stop position is the initial position of the switch lever 41, at which the switch lever 41 protrudes downward through the opening of the lever holder 40.

An interlocking assembly 50 is located above the switch lever 41. The interlocking assembly 50 turns on or off the brake assembly 7 in cooperation with the operation of the switch lever 41. The interlocking assembly 50 includes a slide bar 51 and a link member 52.

The slide bar 51 is a plate narrower than the interval between the engagement tabs 44. The slide bar 51 extends in the front-rear direction. The slide bar 51 has its front end protruding frontward from the motor housing 3 to be in contact with the rear surface of the brake member 32 at the braking position. The slide bar 51 includes a standing portion 53 in its rear end. The rear end of the slide bar 51 is located rearward from the switch 11. The standing portion 53 stands upward behind the plunger 36.

The link member 52 is held by a pin 54, which extends in the lateral direction, in a rotatable manner below the holder 22. The link member 52 includes a front arm 55 and a rear arm 56. The front arm 55 and the rear arm 56 radially protrude with a predetermined angle between them in the rotation direction. The front arm 55 has its distal end located above the slide bar 51 and in contact with the upper ends of the engagement tabs 44. The rear arm 56 has its lower end engaged with the switch lever 41 through a through-hole 45 below the link member 52 in the switch lever 41.

When the brake member 32 is at the braking position, the slide bar 51 is at a retracted position to have the standing portion 53 located behind the plunger 36 without depressing the plunger 36 as shown in FIG. 1. At the same time, the link member 52 is at a left rotational position, at which the rear arm 56 engaged with the slide bar 51 is pulled rearward. The switch lever 41 is at the initial position.

Figure 3:
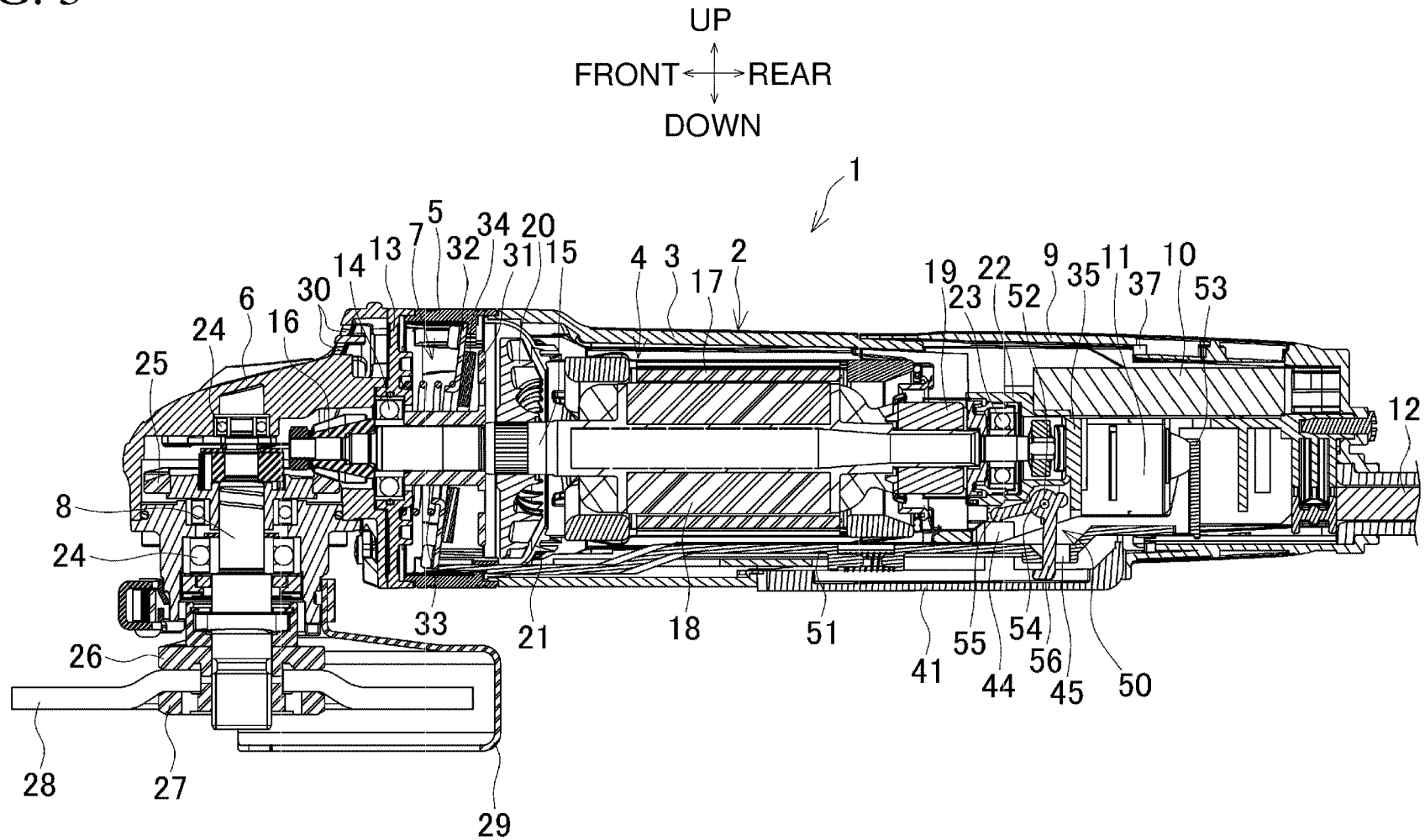
FIG. 3 is a longitudinal central sectional view of the grinder according to the first embodiment in a switch-on state.

In this state, when the switch lever 41 is depressed toward the rear cover 9, the right and left engagement tabs 44 are raised to press the front arm 55 upward. This causes the link member 52 to rotate clockwise in FIG. 1 and then to be located at a right rotational position as shown in FIG. 3, at which the rear arm 56 has moved frontward. At this right rotational position, the rear arm 56 slides the slide bar 51 frontward to press the lower end of the brake member 32 frontward against the urging force from the coil spring 33. At this advanced position, the brake member 32 is moved to the brake release position, at which the brake shoe 34 is away from the brake plate 31.

As the slide bar 51 slides frontward, the advanced standing portion 53 depresses the plunger 36 to turn on the switch 11. In this manner, when the switch lever 41 is depressed, the slide bar 51 is at the advanced position and the link member 52 is at the right rotational position.

To operate the grinder 1 according to the present embodiment, the switch lever 41 is depressed with fingers holding the motor housing 3 and the rear cover 9 forming a grip. The engagement tabs 44 then raise the front arm 55 to rotate the link member 52 to the right rotational position as shown in FIG. 3. The rear arm 56 then slides the slide bar 51 to the advanced position. The slide bar 51 then moves the brake shoe 34 away from the brake plate 31 to release the brake. At the same time, the standing portion 53 advances and then depresses the plunger 36 to turn on the switch 11. The motor 4 is then energized and rotates the output shaft 15 for which the brake is released, and rotates the spindle 8 via the first and second bevel gears 16 and 25. In other words, depressing the switch lever 41 releases the brake and then turns on the switch 11 to drive the motor 4. This allows the tip tool 28 rotating together with the spindle 8 to perform grinding or other operations.

When the fan 20 rotates as the output shaft 15 rotates, outside air is drawn through the inlets 37 in the rear end of the rear cover 9. The drawn air flows through the rear cover 9 and the motor housing 3 to cool the motor 4, then through the brake holder 5, and exits through the outlets 30 in the gear housing 6.

When the switch lever 41 is released from being depressed, the coil spring 33 urges the brake member 32 back to the braking position. In other words, the brake shoe 34 is pressed against the brake plate 31 to apply a brake on the rotating output shaft 15. At the same time, the brake member 32 slides the slide bar 51 to the retracted position. The slide bar 51 then pulls the rear arm 56 rearward to return the link member 52 to the left rotational position, and at the same time, moves the standing portion 53 rearward away from the plunger 36 to turn off the switch 11. In other words, releasing the switch lever 41 from being depressed turns off the switch 11 and then applies a brake.

The grinder 1 according to the first embodiment includes the housing 2 accommodating the motor 4 and extending in the front-rear direction and the switch 11 for driving the motor 4. The grinder 1 also includes the brake assembly 7 including the brake member 32 movable back and forth between the rear braking position, at which a brake is applied to the output shaft 15 in the motor 4, and the front brake release position, at which no brake is applied to the output shaft 15. The grinder 1 also includes the switch lever 41 movable between the initial position at which the switch lever 41 protrudes from the housing 2, and a depressed position at which the switch lever 41 is depressed into the housing 2. The grinder 1 also includes the slide bar 51 (sliding member) slidable between the advanced position (first position) to move the brake member 32 to the brake release position and the retracted position (second position) to move the brake member 32 to the braking position. The grinder 1 also includes the link member 52 rotatable between the right rotational position (first rotational position) to move the slide bar 51 to the advanced position with the switch lever 41 at the depressed position and the left rotational position (second rotational position) to move the slide bar 51 to the retracted position with the switch lever 41 at the initial position. The slide bar 51 turns on the switch 11 at the advanced position and off the switch 11 at the retracted position.

In other words, the slide bar 51 turning on and off the brake assembly 7 turns on and off the switch 11. This structure reduces the number of components and eliminates the likelihood of a cumulative tolerance lowering the operability or causing the brake assembly 7 and the switch 11 to operate at different times. In other words, both the brake assembly 7 and the switch 11 may be operated easily and reliably with a simple structure including fewer components.

The switch 11 is a push switch. The switch 11 includes the plunger 36 protruding rearward and is turned on when the plunger 36 is depressed by the slide bar 51 at the advanced position. In other words, the switch 11 may be easily turned on and off using the slide bar 51. The switch 11 is oriented to have the radially compact design of the rear cover 9, allowing easy gripping.

The slide bar 51 includes, in its rear end, the standing portion 53 for depressing the plunger 36. The plunger 36 is thus reliably depressed as the slide bar 51 advances.

The controller 10 for controlling the motor 4 in response to turning on or off of the switch 11 is located above the switch 11. Thus, the rear cover 9 uses a small space to accommodate the controller 10.

The controller 10 extends laterally in the front-rear direction. This allows the rear cover 9 to accommodate the controller 10 above the switch 11 without increasing the diameter.

When the switch lever 41 is depressed, the brake member 32 moves to the brake release position, and then the switch 11 is turned on. In other words, depressing the switch lever 41 reliably releases a brake before driving the motor 4.

In the first embodiment, the standing portion of the slide bar may be a separate member. The standing portion may also have a different shape. The controller may be positioned or oriented in a manner different from as described above.

Although the link member has the rear arm longer than the front arm in the first embodiment, the rear arm may be shorter than the front arm or both the arms may have the same length. A rear arm longer than a front arm as in the first embodiment will increase the displacement of the front arm when the switch lever is depressed, thus increasing the displacement of the rear arm. This may transfer movement larger than the actual movement of the switch lever to the slide lever, releasing a brake and depressing the plunger reliably. In contrast, a front arm longer than a rear arm may increase the depressing force to the switch lever and then transfer the increased force to the slide bar. This may allow a brake to be released with a small force against an increased urging force from the coil spring for a brake, and improve the operability.

Other embodiments of the present invention will now be described. Similar components as in the first embodiment are indicated by like reference numerals and will not be described repeatedly.

Second Embodiment

Figure 4:
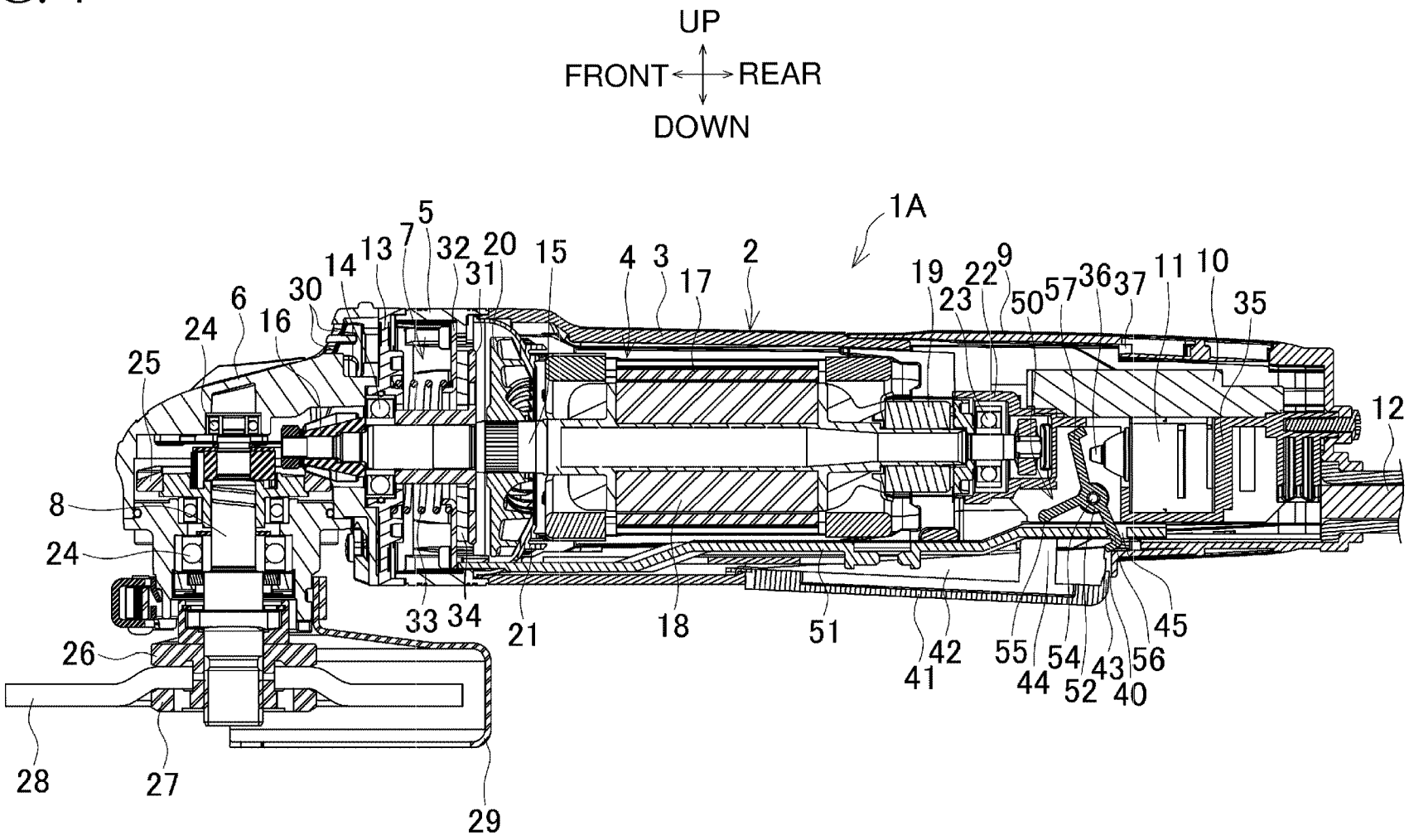
FIG. 4 is a longitudinal central sectional view of a grinder according to a second embodiment in a switch-off state.

In a grinder 1A shown in FIG. 4, the switch 11 faces frontward, instead of rearward, and is held by the switch receiver 35 with the plunger 36 protruding frontward. The slide bar 51 thus has no standing portion. The link member 52 includes the upper arm 57 extending upward at the left rotational position and being located in front of the plunger 36.

Figure 5:
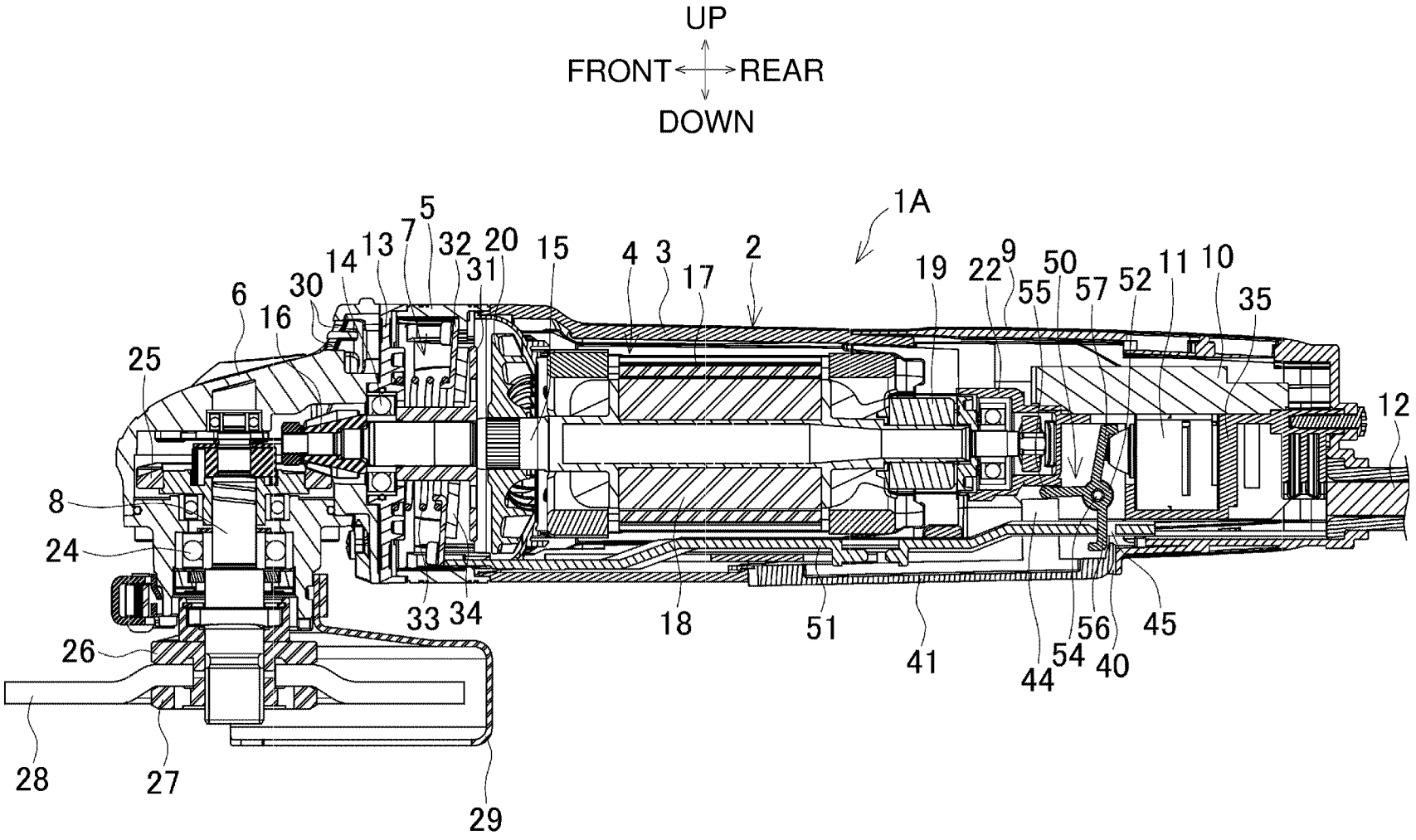
FIG. 5 is a longitudinal central sectional view of the grinder according to the second embodiment in a switch-on state.

When the switch lever 41 is depressed, the engagement tabs 44 raise the front arm 55 to rotate the link member 52 to the right rotational position as shown in FIG. 5. The upper arm 57 then tilts rearward to depress the plunger 36, turning on the switch 11. At the same time, the rear arm 56 slides the slide bar 51 to the advanced position, releasing a brake. The motor 4 is then energized and rotates the output shaft 15 for which a brake is released, thus rotating the spindle 8.

When the switch lever 41 is released from being depressed, the coil spring 33 urges the brake member 32 back to the braking position. In other words, the brake shoe 34 is pressed against the brake plate 31 to apply a brake on the rotating output shaft 15. At the same time, the brake member 32 slides the slide bar 51 to the retracted position. The slide bar 51 then pulls the rear arm 56 rearward to return the link member 52 to the left rotational position. This causes the upper arm 57 to tilt frontward away from the plunger 36, turning off the switch 11.

The link member 52 according to the second embodiment turns on the switch 11 at the right rotational position (first rotational position) and turns off the switch 11 at the left rotational position (second rotational position).

In other words, the slide bar 51 that turns on and off the brake assembly 7 turns on and off the switch 11 via the link member 52. This structure reduces the number of components and eliminates the likelihood of a cumulative tolerance lowering the operability or causing the brake assembly 7 and the switch 11 to operate at different times. In other words, both the brake assembly 7 and the switch 11 may be operated easily and reliably with a simple structure including fewer components.

The switch 11 includes the plunger 36 protruding frontward. The switch 11 is a push switch and turns on when the plunger 36 is depressed by the link member 52 at the right rotational position. In this manner, the link member 52 easily performs the turning-on or off operation.

The link member 52 includes the upper arm 57 (arm) that depresses the plunger 36 at the right rotational position. This allows the plunger 36 to be reliably depressed as the link member 52 rotates.

The upper arm may have a different shape in the second embodiment. The link member may also include a separate arm member to turn on and off the switch. The front arm and the rear arm may have different lengths.

Third Embodiment

Figure 6:
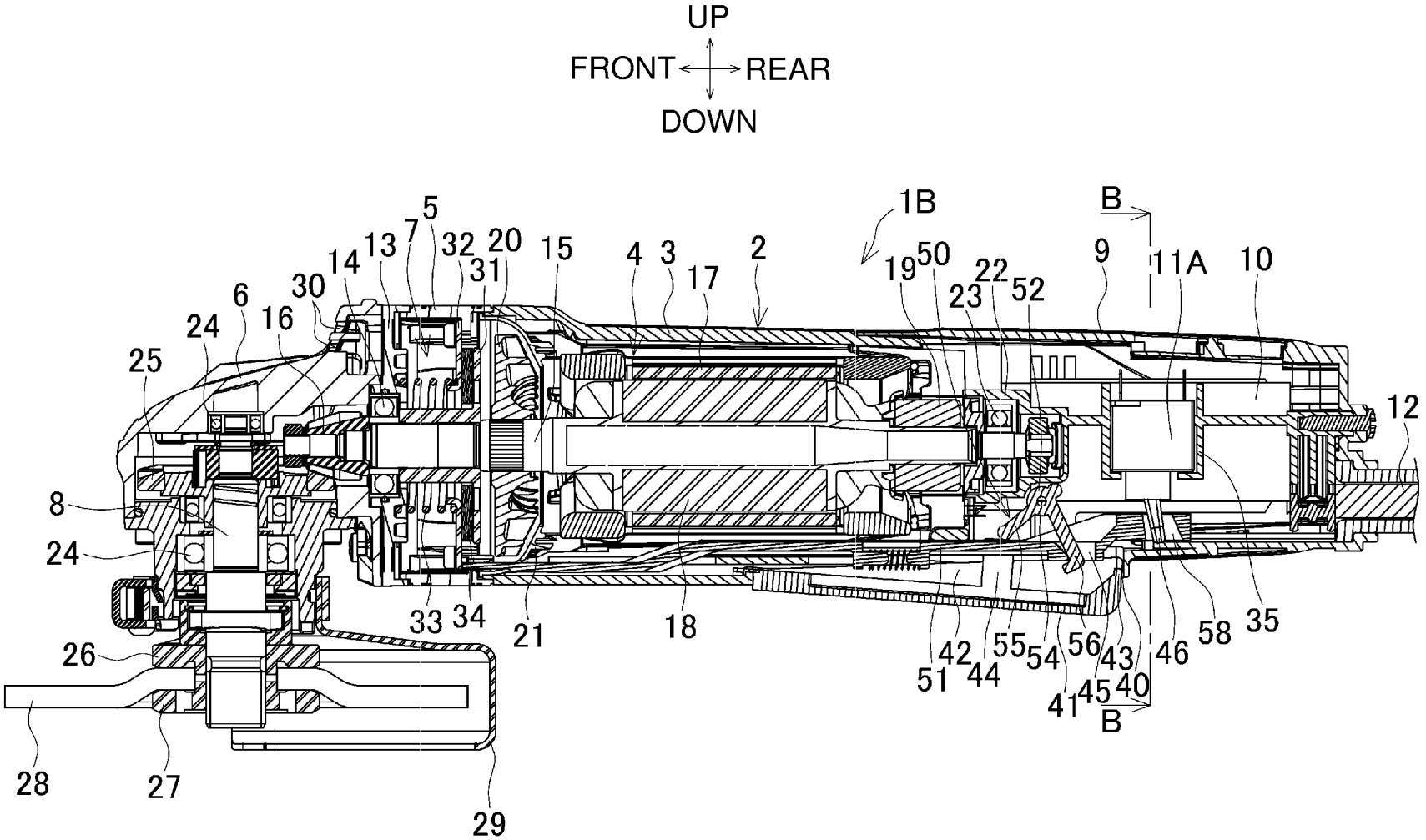
FIG. 6 is a longitudinal central sectional view of a grinder according to a third embodiment in a switch-off state.
Figure 7:
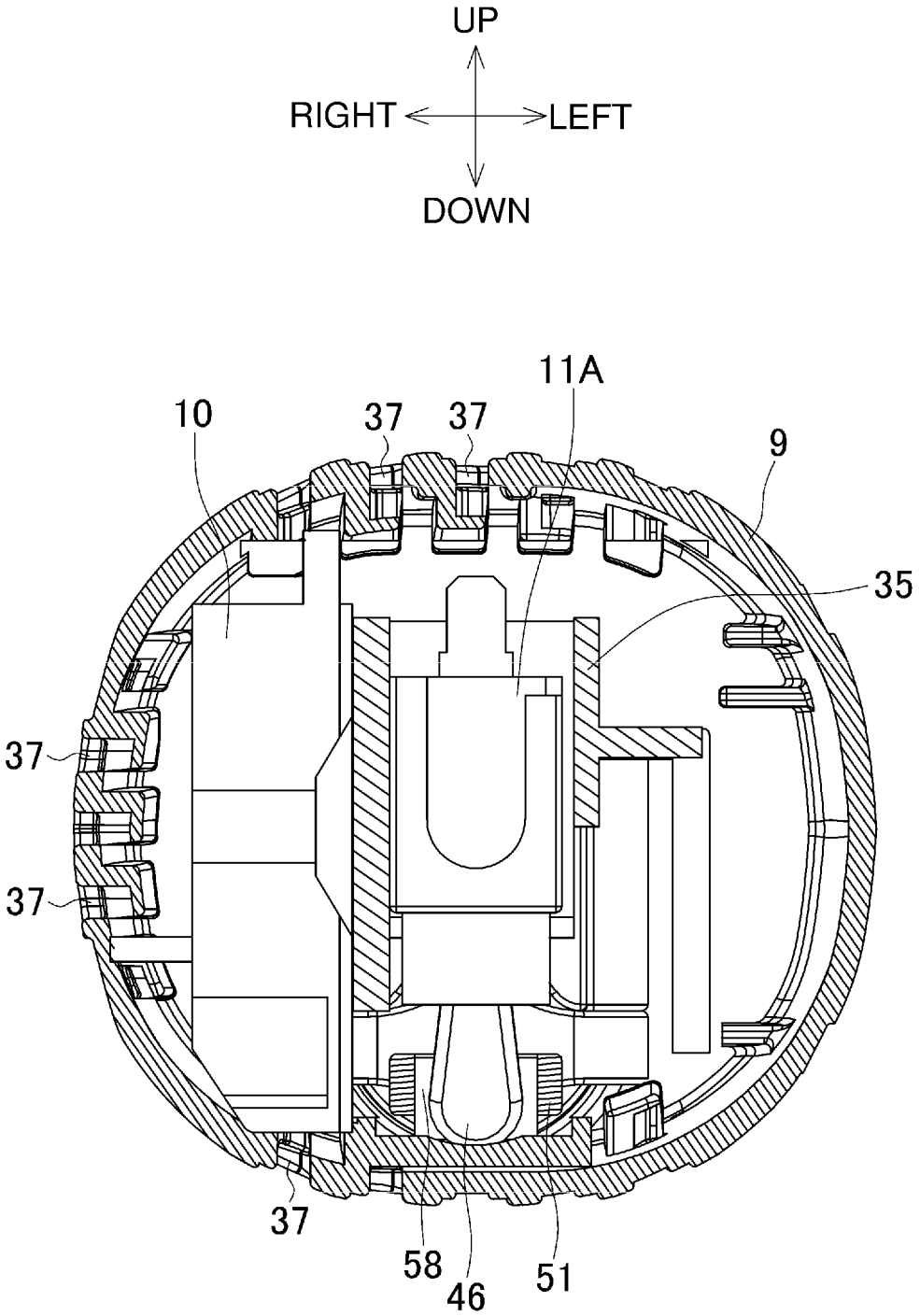
FIG. 7 is an enlarged cross-sectional view taken along line B-B in FIG. 6 (the switch shown is not in a sectional view).

A grinder 1B shown in FIG. 6 includes a switch 11A, which is not a push switch but is a toggle switch to be turned on or off by tilting a lever 46. The switch 11A is held by the switch receiver 35 with the lever 46 pointing downward. The switch 11A is turned on when the lever 46 tilts frontward and turns off when the lever 46 tilts rearward. The slide bar 51 has no standing portion. The link member 52 includes no upper arm. The switch lever 41 has an engagement hole 58 in its rear end, as shown in FIG. 7. The engagement hole 58 receives and engages with the lever 46. The engagement hole 58 causes the lever 46 to tilt frontward when the slide bar 51 is at the advanced position and to tilt rearward when the slide bar 51 is at the retracted position. The controller 10 is vertically accommodated on the right of the switch 11A.

Figure 8:
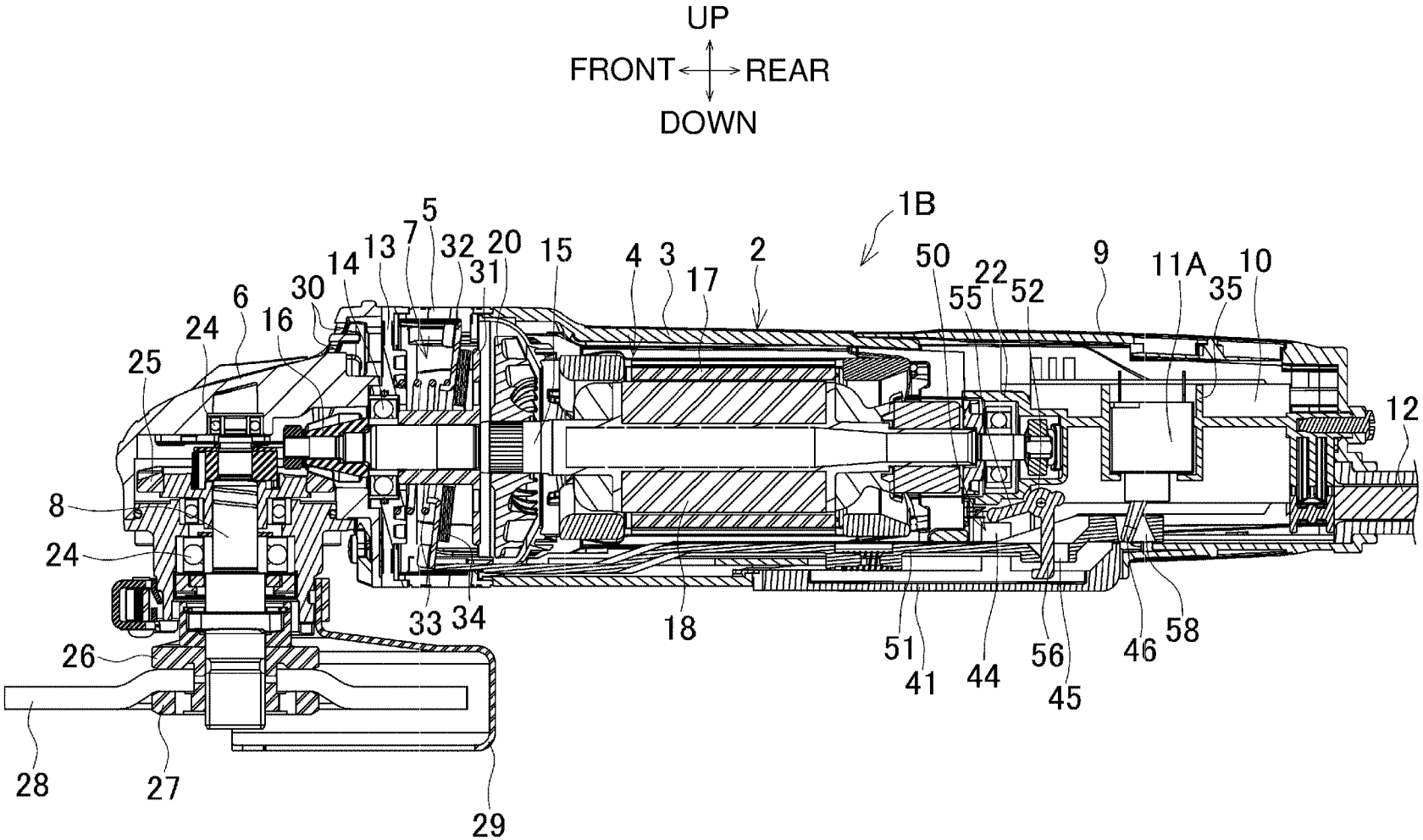
FIG. 8 is a longitudinal central sectional view of the grinder according to the third embodiment in a switch-on state.

When the switch lever 41 is depressed, the engagement tabs 44 raise the front arm 55 to rotate the link member 52 to the right rotational position as shown in FIG. 8. The rear arm 56 then slides the slide bar 51 to the advanced position, releasing a brake. At the same time, the engagement hole 58 advances to cause the lever 46 to tilt frontward, turning on the switch 11A. The motor 4 is then energized and rotates the output shaft 15 for which a brake is released, thus rotating the spindle 8.

When the switch lever 41 is released from being depressed, the coil spring 33 urges the brake member 32 back to the braking position. In other words, the brake shoe 34 is pressed against the brake plate 31 to apply a brake on the rotating output shaft 15. At the same time, the brake member 32 slides the slide bar 51 to the retracted position. The slide bar 51 then pulls the rear arm 56 rearward to return the link member 52 to the left rotational position, and at the same time tilts the lever 46 rearward with the engagement hole 58 to turn off the switch 11A.

The slide bar 51 according to the third embodiment turns on the switch 11A at the advanced position and turns off the switch 11A at the retracted position.

In other words, the slide bar 51 that turns on and off the brake assembly 7 turns on and off the switch 11A. This structure reduces the number of components and eliminates the likelihood of a cumulative tolerance lowering the operability or causing the brake assembly 7 and the switch 11A to operate at different times. In other words, both the brake assembly 7 and the switch 11A may be operated easily and reliably with a simple structure including fewer components.

The switch 11A includes the lever 46 protruding downward. The switch 11A is a toggle switch and is turned on when the lever 46 is swung by the slide bar 51 at the advanced position. In this manner, the slide bar 51 may easily perform the turning-on or off operation.

The controller 10 is located on the right of the switch 11A. Thus, the rear cover 9 uses a small space to accommodate the controller 10 when the toggle switch is used.

The controller 10 extends vertically in the front-rear direction. This allows the rear cover 9 to accommodate the controller 10 beside the switch 11A without increasing its diameter.

In the third embodiment, the slide bar may engage with the lever of the switch using a recess formed on the slide bar, instead of using the engagement hole.

The controller may be located on the left of the switch, instead of on the right. The front arm and the rear arm may have different lengths.

Modifications common to the embodiments will now be described.

The switch lever may be formed on the top surface or the side surface of the housing instead of on the lower surface. In this case, the sliding member and the link member may also be located on the upper surface or the side surface together with the switch lever. The switch may be oriented differently.

Although a brake is released at the advanced position of the sliding member and a brake is applied at the retracted position of the sliding member, a different brake assembly may be used. A brake may be released at the retracted position (first position) of the sliding member, and a brake may be applied at the advanced position (second position) of the sliding member.

The switch lever may swing about the rear end, instead of about the front end.

The motor may be a brushless motor. The controller may be at a different location.

The grinder may not be powered by alternating current (AC) but may be powered by direct current (DC) from a battery pack attached on the rear end of the housing.

REFERENCE SIGNS LIST

1, 1A, 1B grinder
2 housing
3 motor housing
4 motor
5 brake holder
6 gear housing
7 brake assembly
8 spindle
9 rear cover
10 controller
11, 11A switch
15 output shaft
28 tip tool
31 brake plate
32 brake member
33 coil spring
34 brake shoe
35 switch receiver
36 plunger
40 lever holder
41 switch lever
44 engagement tab
45 through-hole
46 lever
50 interlocking assembly
51 slide bar
52 link member
53 standing portion
55 front arm
56 rear arm
57 upper arm
58 engagement hole

What is claimed is:

1. A grinder, comprising:

a motor including an output shaft having a longitudinal rotation axis in a front-rear direction;

a housing accommodating the motor and extending in the front-rear direction;

a switch in the housing and configured to drive the motor;

a brake member in the housing and movable between a rear braking position to apply a brake on the output shaft and a front brake release position to release the brake on the output shaft;

a switch lever (i) movable between an initial position to protrude from the housing and a depressed position to be depressed into the housing and (ii) having a through-hole;

a sliding member (i) in the housing, (ii) slidable between a first position to move the brake member to the front brake release position and a second position to move the brake member to the rear braking position, and (iii) being configured to turn on the switch at the first position and turn off the switch at the second position; and a link member (i) in the housing, (ii) rotatable between a first rotational position to move the sliding member to the first position at the depressed position of the switch lever and a second rotational position to move the sliding member to the second position at the initial position of the switch lever, (iii) between the switch and the brake member and (iv) including:

a front arm (a) extending radially and in contact with the switch lever and (b) being configured to rotate the link member to the first rotational position and the second rotational position in accordance with movement of the switch lever; and a rear arm (a) extending radially, (b) engaged with the sliding member through the through-hole and (c) being configured to move the sliding member to the first position and the second position in accordance with rotation of the link member to the first rotational position and the second rotational position.

2. The grinder according to claim 1, wherein the first position is an advanced position for the sliding member, and the second position is a retracted position for the sliding member.

3. The grinder according to claim 2, wherein the switch is a push switch including a plunger protruding rearward, and the sliding member and the switch are configured such that the switch is turned on in response to the plunger being depressed by the sliding member at the advanced position.

4. The grinder according to claim 3, wherein the sliding member includes a rear end including a standing portion configured to depress the plunger.

5. The grinder according to claim 1, wherein the switch is (i) a toggle switch including a lever protruding downward and (ii) configured to be turned on in response to the lever being swung by the sliding member at the first position.

6. The grinder according to claim 5, further comprising:

a controller on a right or a left of the switch and configured to control the motor in response to an on or off operation of the switch.

7. The grinder according to claim 1, wherein the brake member, the switch lever and the switch are configured such that, in response to the switch lever being depressed, the brake member moves to the brake release position before the switch is turned on.

8. A grinder, comprising:

a motor including an output shaft having a longitudinal rotation axis in a front-rear direction;

a housing accommodating the motor and extending in the front-rear direction;

a switch in the housing and configured to drive the motor;

a brake member in the housing and movable between a rear braking position to apply a brake on the output shaft and a front brake release position to release the brake on the output shaft;

a switch lever (i) movable between an initial position to protrude from the housing and a depressed position to be depressed into the housing and (ii) having a through-hole;

a sliding member (i) in the housing and (ii) slidable between a first position to move the brake member to the front brake release position and a second position to move the brake member to the rear braking position; and a link member (i) in the housing, (ii) rotatable between a first rotational position to move the sliding member to the first position at the depressed position of the switch lever and a second rotational position to move the sliding member to the second position at the initial position of the switch lever, (iii) being configured to turn on the switch at the first rotational position and turn off the switch at the second rotational position, (iv) between the switch and the brake member, and (v) including:

a front arm (a) extending radially and in contact with the switch lever and (b) being configured to rotate the link member to the first rotational position and the second rotational position in accordance with movement of the switch lever, a rear arm (a) extending radially and engaged with the sliding member through the through-hole and (b) being configured to move the sliding member to the first position and the second position in accordance with rotation of the link member to the first rotational position and the second rotational position.

9. The grinder according to claim 8, wherein the first position is an advanced position for the sliding member, and the second position is a retracted position for the sliding member.

10. The grinder according to claim 9, wherein the switch is a push switch including a plunger protruding frontward, and the sliding member and the switch are configured such that the switch is turned on in response to the plunger being depressed by the link member at the first rotational position.

11. The grinder according to claim 8, further comprising:

a controller above the switch and configured to control the motor in response to an on or off operation of the switch.

12. The grinder according to claim 11, wherein the controller extends laterally in the front-rear direction.

13. The grinder according to claim 8, wherein the brake member, the switch lever and the switch are configured such that, in response to the switch lever being depressed, the brake member moves to the brake release position before the switch is turned on.

* * * * *